US008480199B2

(12) United States Patent
Chen et al.

(10) Patent No.: US 8,480,199 B2
(45) Date of Patent: Jul. 9, 2013

(54) METHOD OF PRINTING WITH ANTI-CURL SOLUTION

(75) Inventors: Huijuan D. Chen, San Diego, CA (US); James A. Reczek, Rochester, NY (US); Richard P. Szajewski, Rochester, NY (US); Douglas W. Couwenhoven, Fairport, NY (US); Richard C. Reem, Hilton, NY (US); Richard A. Dibiase, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 246 days.

(21) Appl. No.: 12/949,960

(22) Filed: Nov. 19, 2010

(65) Prior Publication Data

US 2012/0127226 A1 May 24, 2012

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS

| | | | | |
|---|---|---|---|---|
| 5,075,689 | A * | 12/1991 | Hoisington et al. | 347/41 |
| 5,633,662 | A | 5/1997 | Allen et al. | |
| 5,748,785 | A | 5/1998 | Mantell et al. | |
| 5,764,263 | A | 6/1998 | Lin | |
| 5,861,900 | A * | 1/1999 | Lu et al. | 347/43 |
| 6,966,944 | B2 | 11/2005 | Shimomura et al. | |
| 7,208,032 | B2 | 4/2007 | Hakamada et al. | |
| 7,604,344 | B2 | 10/2009 | Seki et al. | |
| 8,079,694 | B2 * | 12/2011 | Steed et al. | 347/98 |
| 2006/0066653 | A1 * | 3/2006 | Konno | 347/14 |
| 2008/0241398 | A1 * | 10/2008 | Kato et al. | 427/288 |
| 2011/0096120 | A1 * | 4/2011 | Taya | 347/20 |

* cited by examiner

*Primary Examiner* — Geoffrey Mruk
*Assistant Examiner* — Bradley Thies
(74) *Attorney, Agent, or Firm* — Peyton C. Watkins

(57) ABSTRACT

A method of printing with an inkjet printer, the method includes moving the carriage along a first carriage scan direction while the second drop ejector array ejects drops of anti-curl solution onto the portion of recording medium providing a delay time that is greater than 15 milliseconds after the second drop ejector ejects drops of anti-curl solution at a given location on the portion of recording medium and before printing with the first drop ejector array moving the carriage along a second carriage scan direction while the first drop ejector array ejects drops of ink in an image-wise fashion onto the given location of the portion of recording medium.

20 Claims, 8 Drawing Sheets

METHOD OF PRINTING WITH ANTI-CURL SOLUTION

CROSS-REFERENCE TO RELATED APPLICATIONS

Reference is made to commonly assigned, co-pending U.S. patent application Ser. No. 12/949,937 filed Nov. 19, 2010, entitled: "Ejecting Anti-Curl Solution in Carriage Printers", the disclosure of which is incorporated herein.

FIELD OF THE INVENTION

This invention relates generally to the field of inkjet printing, and in particular to application of an anti-curl solution to reduce the amount of paper curl.

BACKGROUND OF THE INVENTION

An inkjet printing system typically includes one or more printheads and their corresponding ink supplies. A printhead includes an ink inlet that is connected to its ink supply and an array of drop ejectors, each ejector including an ink pressurization chamber, an ejecting actuator and a nozzle through which droplets of ink are ejected. The ejecting actuator may be one of various types, including a heater that vaporizes some of the ink in the chamber in order to propel a droplet out of the nozzle, or a piezoelectric device that changes the wall geometry of the ink pressurization chamber in order to generate a pressure wave that ejects a droplet. The droplets are typically directed toward paper or other print medium (sometimes generically referred to as recording medium or paper herein) in order to produce an image according to image data that is converted into electronic firing pulses for the drop ejectors as the print medium is moved relative to the printhead.

Motion of the print medium relative to the printhead can consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads. A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a carriage scan direction that is substantially perpendicular to the print medium advance direction as the drops are ejected from the nozzles. After the carriage has printed a swath of the image while traversing the print medium, the print medium is advanced, the carriage direction of motion is reversed, and the image is formed swath by swath.

Inkjet ink includes a variety of volatile and nonvolatile components including pigments or dyes, humectants, image durability enhancers, and carriers or solvents. Inkjet inks used in printers for the home or office typically include a high percentage of water—on the order of 80%. Water can interact with the paper being printed on to cause the paper to curl, due to differential stresses on the printed surface and the non-printed surface for pages printed with relatively high ink coverage on one side of the paper. Curl can appear immediately after printing or it may take a day or so to appear. In a severe case of curl, the paper sheet can roll up like a scroll so that it cannot be stacked sheet upon sheet. In addition to the amount of ink coverage, another important factor affecting the severity of curl is the type of paper. Many types of papers designed for inkjet printing are made to have small built-in differential stress between printed and unprinted sides after printing and show little curl even for high ink coverage. Such papers are typically thicker and have higher mechanical strength than so-called plain papers that are for general use and not optimized for inkjet printing. However, some of the specially designed papers for inkjet are significantly more expensive than plain papers, so that the user may choose to use plain papers for many print jobs. While plain paper can be satisfactory for low amounts of ink coverage, for example typical text printing, there can be an objectionable amount of paper curl when printing color graphics or photographs.

A variety of approaches have been used to reduce the amount of curl. In some piezoelectric inkjet printers an anti-curl solution is added to the inks. However this typically causes the inks to be somewhat viscous. Such a solution is typically not feasible for thermal inkjet printers. U.S. Pat. No. 7,208,032 and U.S. Pat. No. 7,604,344 disclose an inkjet printing apparatus having a coating roller to apply an anti-curl solution to the paper after it is picked from the paper input tray and before it reaches the printing region. However, such an architecture can be complex and costly and in some instances can apply anti-curl solution whether it is needed or not, so that it can be wasteful and require objectionably frequent replacement of anti-curl solution by the user. U.S. Pat. No. 5,633,662 discloses selecting a maximum ink volume per pixel to provide good color coverage while avoiding paper curl, bleeding, etc. While this method avoids the use of anti-curl solution, it is inherently limited in the intensity of printed images that can be produced. U.S. Pat. No. 5,764,263 discloses printing an optically clear aqueous liquid containing anti-curl agents on the opposite side of the paper from a printed image. While this can be effective, it results in an overly complex and bulky printing system.

What is needed is a simple low-cost printing system and method of printing that can be used to reduce curl to acceptable levels in low-cost inkjet carriage printers without compromising print quality, and without applying anti-curl solution in a wasteful manner.

SUMMARY OF THE INVENTION

A method of printing with an inkjet printer, the method comprising (a) providing a printhead including at least first drop ejector array and a second drop ejector array; (b) providing a carriage for moving the printhead along a printing region of the inkjet printer; (c) providing an ink supply that is fluidically connected to the first drop ejector array; (d) providing an anti-curl solution supply that is fluidically connected to the second drop ejector array; (e) providing a controller for controlling the printing operations of the printer; (f) advancing a portion of recording medium into the printing region; (g) moving the carriage along a first carriage scan direction while the second drop ejector array ejects drops of anti-curl solution onto the portion of recording medium that is in the printing region; (h) providing a delay time that is greater than 15 milliseconds after the second drop ejector ejects drops of anti-curl solution at a given location on the portion of recording medium; (i) moving the carriage along a second carriage scan direction while the first drop ejector array ejects drops of ink in an image-wise fashion onto the given location of the portion of recording medium according to control by the controller to form a swath of image; and (j) repeating steps f) through i) to form an image swath by swath on the recording medium.

DETAILED DESCRIPTION OF THE INVENTION

Figure 1:
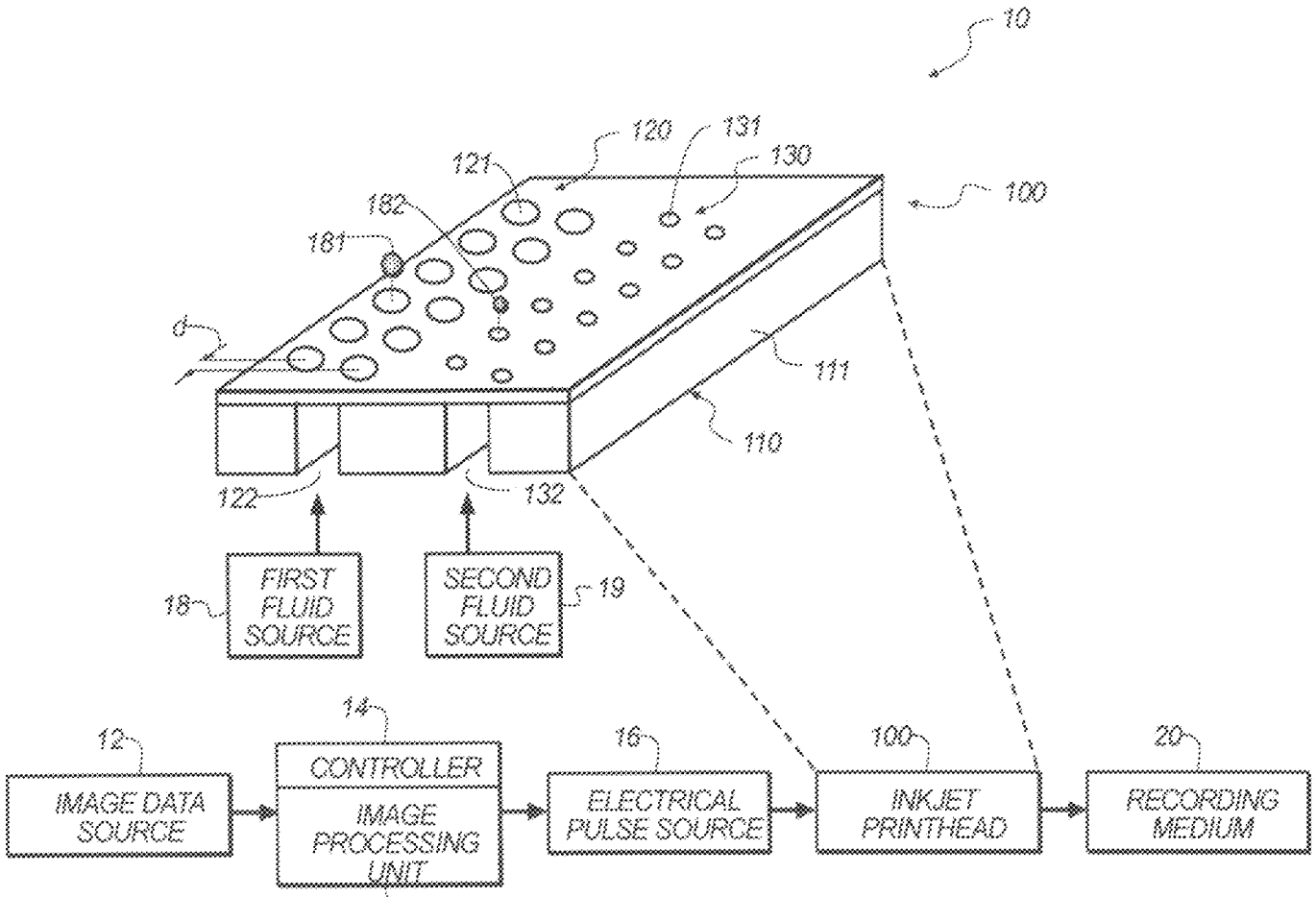
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110. In other words, printing of an image is performed according to control by the controller 14.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nuzzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize it portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. (A drop ejector includes both the drop forming mechanism and the nozzle. Sometimes the terms "drop ejector array" and "nozzle array" are used interchangeably herein to mean the same thing, as the nozzle is the externally visible portion of the drop ejector.) In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
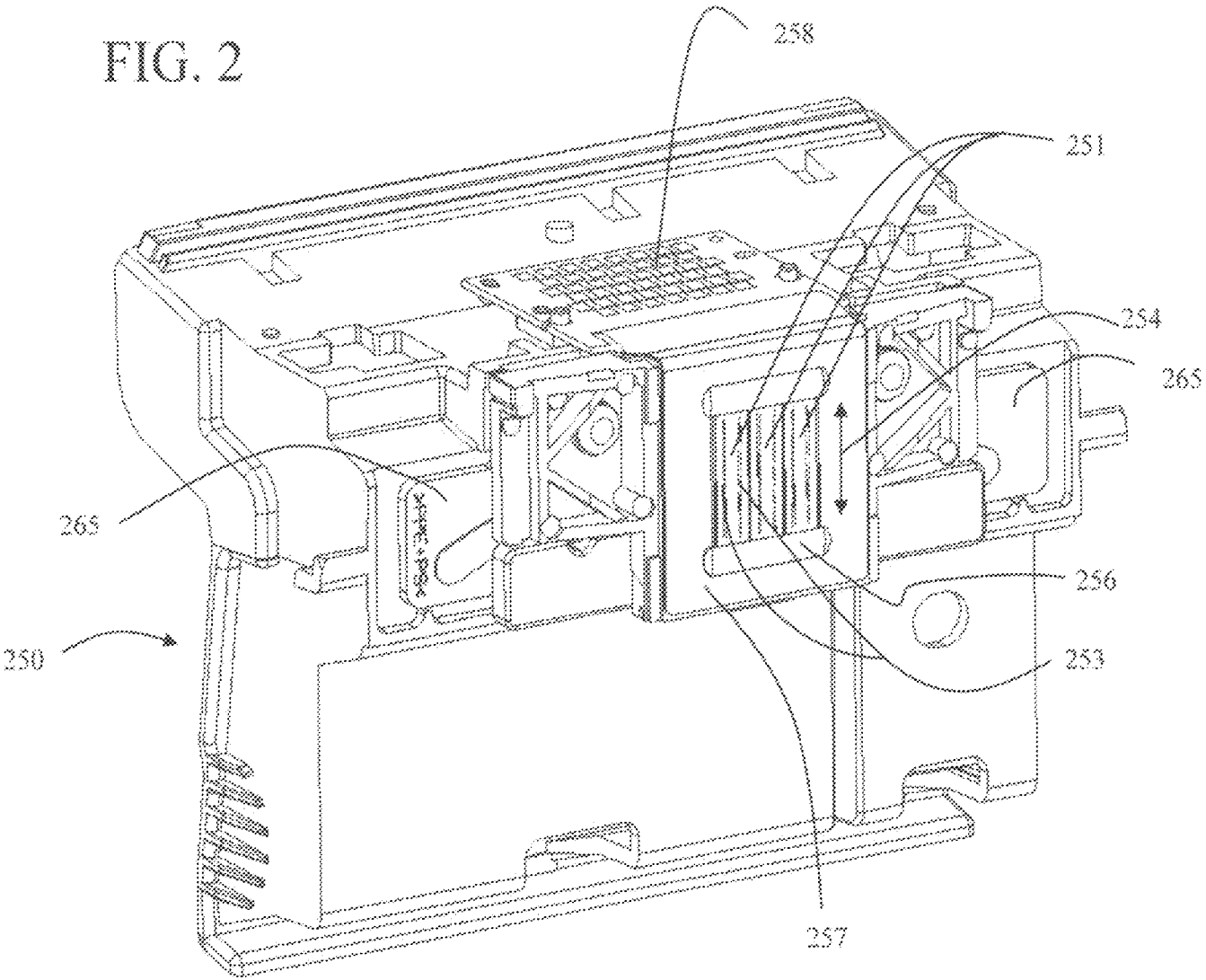
FIG. 2 is a perspective view old printhead, as seen from the side including the printhead die.

FIG. 2 shows a perspective view of a portion of a printhead 250, which is an example of an inkjet printhead 100. Printhead 250 includes three printhead die 251 (similar to printhead die 110 in FIG. 1), each printhead die 251 containing two nozzle arrays 253, so that printhead 250 contains six nozzle arrays 253 altogether. The six nozzle arrays 253 in this example can each be connected to separate ink sources (see multi-chamber ink tank 262 and single chamber ink tank 264 in FIG. 3); such as cyan, magenta, yellow, text black, photo black, and a colorless printing fluid. In an embodiment of the present invention, the colorless printing fluid can be an anti-curl solution as discussed in more detail below. In order to provide a supply of ink for several hundred pages, the ink tanks are typically significantly wider than the printhead die 251, so that in order to hold the ink tanks, printhead 250 is significantly wider than the region where the three printhead die 251 are located. A manifold 265 extends across the width of printhead 250 and provides ink passageways between relatively widely spaced inlet ports 242 (see FIG. 5) and the relatively closely spaced outlets that bring ink or other printing fluids to the six nozzle arrays 253 (e.g. through closely spaced ink delivery pathways 122 and 132 as shown in FIG. 1).

Each of the six nozzle arrays 253 is disposed along nozzle array direction 254, and the length of each nozzle array along the nozzle array direction 254 is typically on the order of 1 inch or loss. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAR bonding. The interconnections are covered by an encapsulant 256 to protect them. Flex circuit 257 bends around the side of printhead 250 and connects to connector board 258. When printhead 250 is mounted into the carriage 200 (see FIG. 3), connector board 258 is electrically connected to a connector (not shown) on the carriage 200, so that electrical signals can be transmitted to the printhead die 251.

Figure 3:
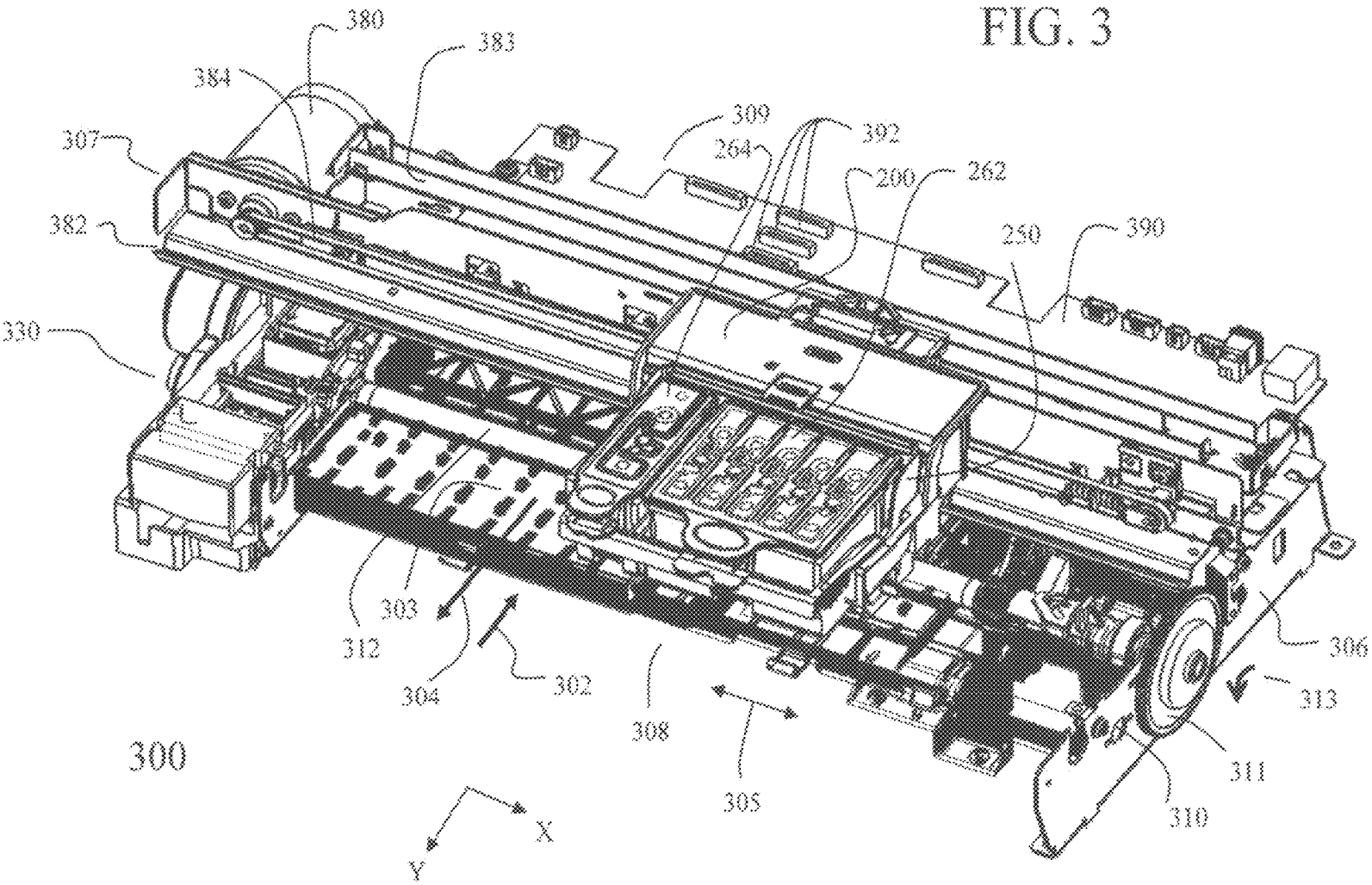
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a printing region 303 along which carriage 200 is moved back and forth in carriage scan direction 305 along the X axis, between the right side 306 and the led side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink tank 262 and single-chamber ink tank 264 are installed in the printhead 250. The mounting orientation of printhead 250 is rotated relative to the view in FIG. 2, so that the printhead die 251 are located at the bottom side of printhead 250, the droplets of ink being ejected downward onto the recording medium in priming region 303 in the view of FIG. 3. Multi-chamber ink tank 262, in this example, contains five sources of ink or other fluids for printing: cyan, magenta, yellow, photo black and colorless printing fluid (which can be anti-curl solution in embodiments of the present invention); while single-chamber ink tank 264 contains the ink source for text black. In other embodiments, rather than having a multi-chamber ink tank to hold several ink sources, all ink and fluid sources are held in individual single chamber ink tanks. As carriage 200 moves along carriage scan direction 305, it carries the ink supplies and other fluid supplies (including anti-curl solution, for example) with it in the printer configuration shown in FIG. 3. In other printer configurations, the ink supplies and/or the anti-curl solution supply can be located remotely from the carriage and connected to the printhead by flexible tubing. Such a fluid supply configuration is sometimes called an off-axis supply.

Figure 4:
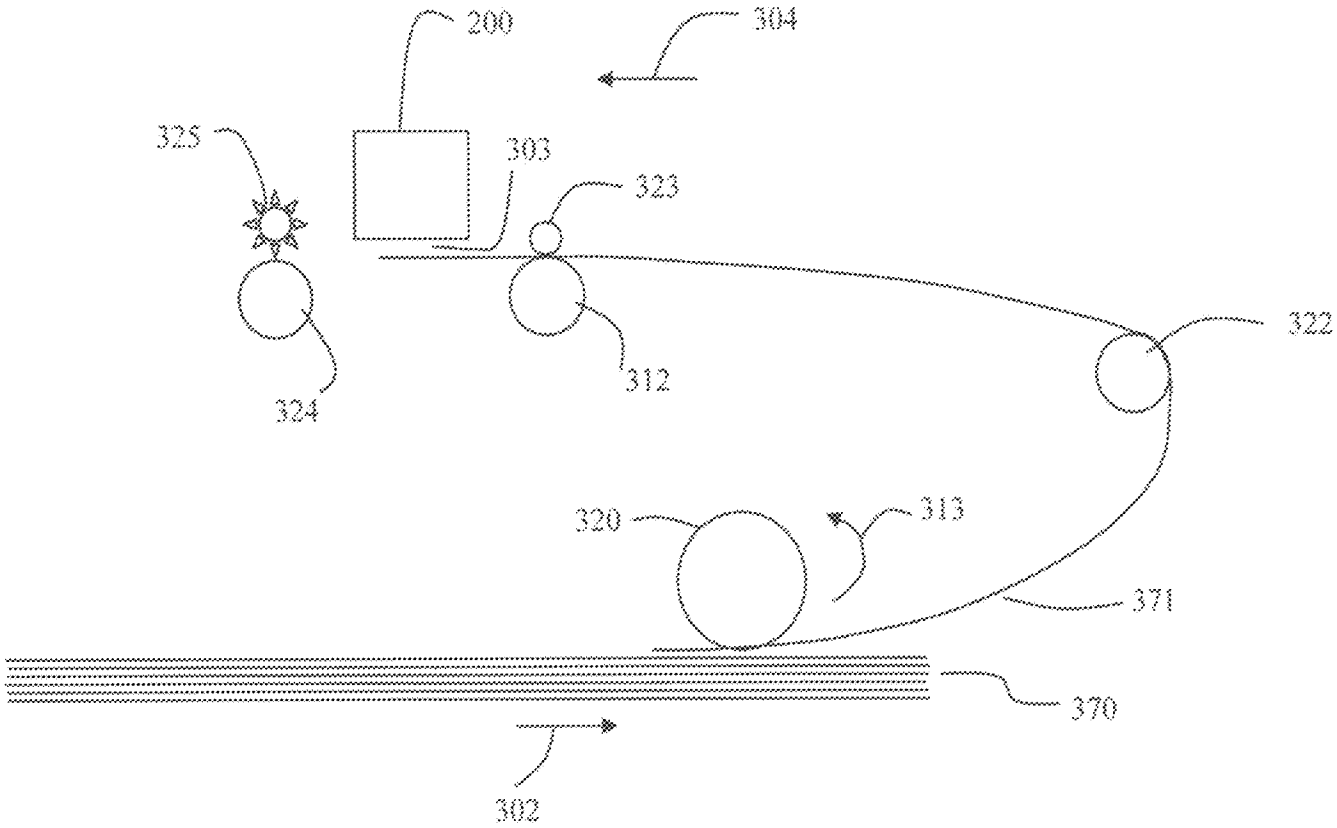
FIG. 4 is a schematic side view of an exemplary paper path in a carriage printer.

Paper or other recording medium (sometimes generically referred to as paper or media herein) is loaded along paper load entry direction 302 toward the front of printer chassis 308. A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across printing region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shall. A rotary encoder (not shown) can be coaxially mounted on the teed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics hoard 390, which includes cable connectors 392 for communicating via cables (not shown) to the printhead carriage 200 and from there to the printhead 250. Also on the electronics board are typically mounted one or more power supplies, motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
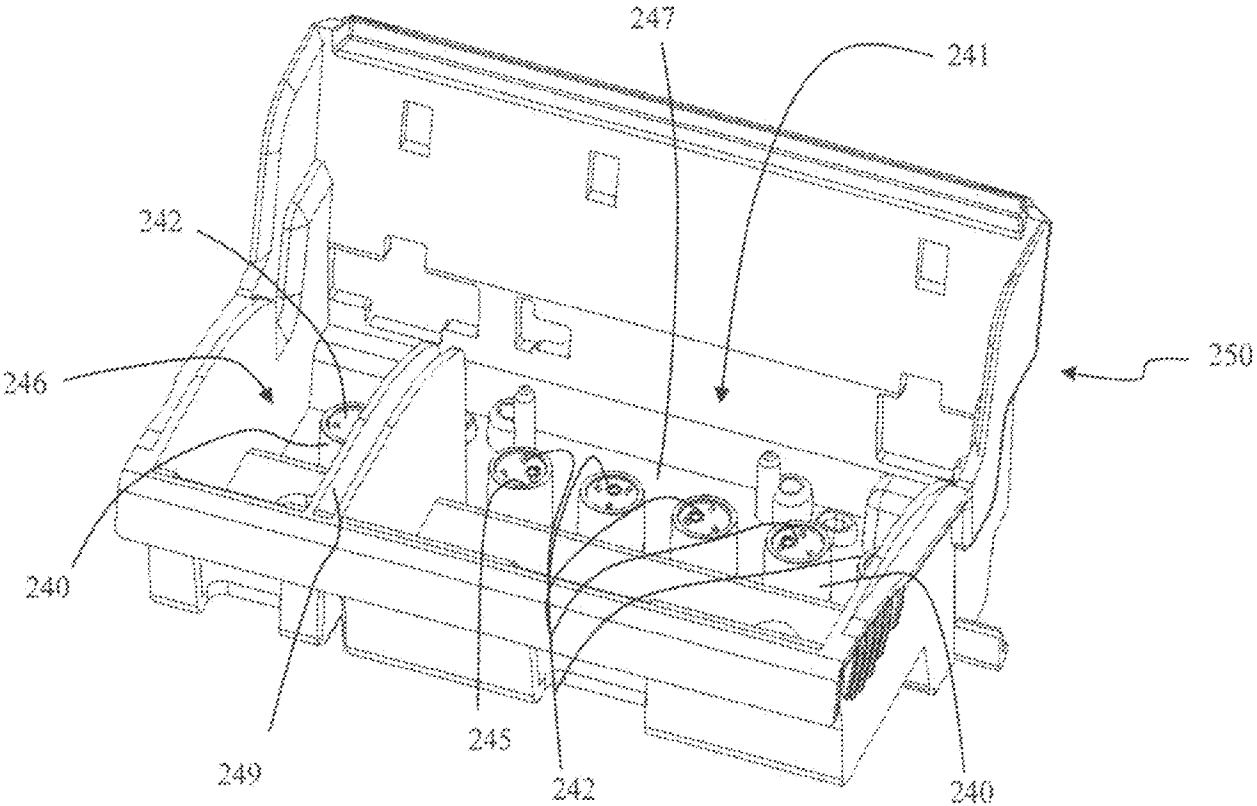
FIG. 5 is a perspective view of a printhead, as seen from the side including the ink tank holding regions.

FIG. 5 shows a perspective view of printhead 250 (rotated with respect to FIG. 2) without either replaceable ink tank 262 or 264 mounted onto it. Multi-chamber ink tank 262 (see FIG. 3) is detachably mountable in ink tank holder 241 and single chamber ink tank 264 is detachably mountable in ink tank holder 246 of printhead 250. Ink tank holder 241 is separated from ink tank holder 246 by a wall 249, which can also help guide the ink tanks during installation. Five inlet ports 242 are shown in holder 241 that connect with outlet ports (not shown) of multi-chamber ink tank 262 when it is installed onto printhead 250, and one inlet port 242 is shown in holder 246 for the outlet port (not shown) on the single chamber ink tank 264. In the example of FIG. 5 each inlet port 242 has the form of a standpipe 240 that extends from the floor of printhead 250. Typically a filter (such as woven or mesh wire filter, not shown) covers the end 245 of the standpipe 240. On the floor of printhead 250 surrounding standpipes 240 of inlet ports 242 is an elastomeric gasket 247. When an ink tank is installed into the corresponding ink tank holder 241 or 246 of printhead 250, it is in fluid communication with the printhead because of the connection of outlet ports of the ink tank with the ends 245 of standpipes 240 of inlet ports 242.

In embodiments of the present invention an anti-curl solution supply is fluidically connected to one of the drop ejector arrays (i.e. to one of the nozzle arrays 253) that are part of printhead 250 that is moved along printing region 303 by carriage 200. Anti-curl solution is ejected onto recording medium from the drop ejector array. At least one other drop ejector array (nozzle array 253) of printhead 250 is fluidically connected to an ink supply, e.g. for printing cyan, magenta, yellow and/or black onto the recording medium.

Experiments have shown that ejecting anti-curl solution on top of a region of printed image can be very effective in reducing the amount of curl in a printed document. However, it is also found that applying a clear anti-curl solution on top can wash out an image, causing colors to be less dense, and can also result in a mottled appearance or uneven spots in the image. It is also found that ejecting anti-curl solution in a region prior to printing the portion of image in that region can be effective in reducing curl to acceptable levels, but the effectiveness is very dependent upon the amount of delay time between ejecting the anti-curl solution onto a region of paper and printing on the same region of paper.

Figure 6A:
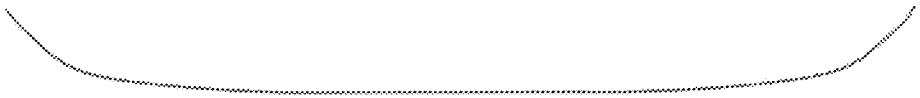
FIGS. 6A to 6C schematically show end views of various amounts of curl in a recording medium.
Figure 6B:
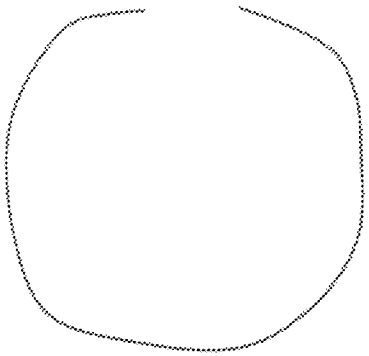
Figure 6C:
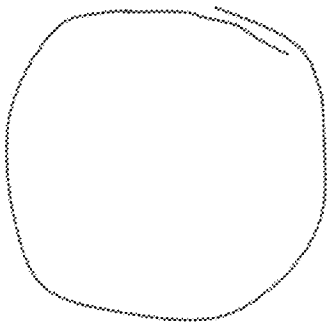

The schematic end views of curled paper in FIGS. 6A, 6B and 6C represent approximate amounts of curl when ejecting a particular amount of anti-curl solution in a given location prior to printing a given ink coverage of about 75% but with different delay times between ejecting anti-curl solution and printing ink in the same location. FIG. 6A represents an acceptable amount of curl (about 50 degrees) that was achieved when the delay time was about 22 milliseconds. FIG. 6B represents an unacceptable amount of curl (nearly 360 degrees) that resulted when the delay time was about 13 milliseconds. FIG. 6C represents an unacceptable amount of curl (over 360 degrees) that resulted when the delay time was about 4 milliseconds. The amount of curl also depends upon the type of paper and the amount of ink coverage. However, a delay time of greater than 15 milliseconds is preferred, and a delay time of greater than 20 milliseconds is even more preferred. The anti-curl solution in this example included 21.5% glycerol humectant, 16.1% polyethylene glycol 600 humectant, 0.1% triethanolamine buffer, 0.25% Surfynol 465 surfactant, and about 62% water. Other water contents are satisfactory, but a water content of greater than 50% and less than 75% is preferred in the anti-curl solution. The viscosity of the anti-curl solution was 4.15 centipoises. A viscosity of greater than 3.0 centipoises is preferred for the anti-curl solution.

There are several alternative ways for providing a 20 millisecond or greater delay between ejecting anti-curl solution onto a given location of recording medium 20 using one drop ejector array 253 being moved by the carriage 200 and printing with ink at the given location using at least one other drop ejector array 253 being moved by carriage 200. Four of these ways are schematically shown in FIGS. 7A to 7D for four different drop ejector array configurations.

Figure 7B:
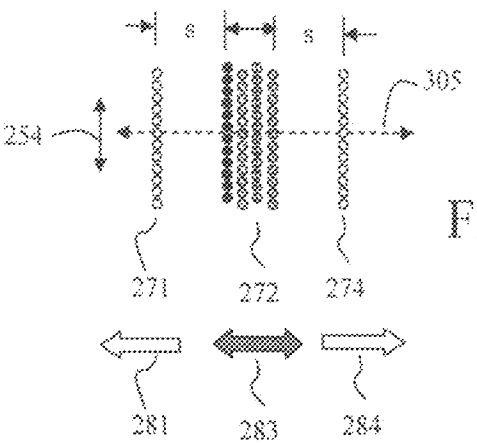
FIGS. 7A to 7D show various configurations of anti-curl solution drop ejector arrays relative to ink-ejecting drop ejector arrays and corresponding printing directions, according to an embodiment of the invention.
Figure 7A:
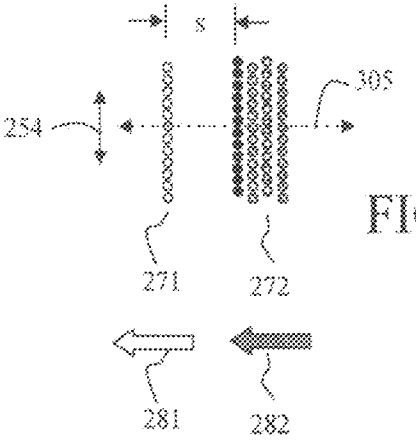

FIG. 7A shows a drop ejector array 271 that is supplied with anti-curl solution, and a plurality of drop ejector arrays 272 that are supplied with different color inks (Or printing (for example, black, cyan, magenta and yellow). All of the drop ejector arrays 271 and 272 are disposed along nozzle array direction 254 and are moved bidirectionally along carriage scan direction 305. For simplicity, each drop ejector array is represented by a linear array of nozzles, but two staggered arrays of nozzles with a corresponding ink delivery pathway could alternatively be used as discussed above relative to FIG. 1. In addition, FIG. 7A shows the nozzles as all being the same size, but different sized nozzles could be used in different drop ejector arrays as discussed above relative to FIG. 1. Drop ejector array 271 (for ejecting anti-curl solution) is shown spaced away by a distance s along carriage scan direction 305 from the nearest of the ink-printing drop ejector arrays 272. The drop ejectors of drop ejector array 271 are substantially in line with the drop ejectors of the ink-printing drop ejector arrays 272 along carriage scan direction 305. Neighboring drop ejector arrays in the ink-printing drop ejector arrays 272 are offset from each other by half a nozzle separation distance along the nozzle array direction 254, but the uppermost drop ejector in drop ejector array 271 is substantially in line with the uppermost drop ejector in each of the drop ejector arrays 272 in this example. The distance s is chosen to provide a 20 millisecond delay time, for example, between drops of anti-curl solution from drop ejector array 271 hitting a given location on the recording medium and the first drops of ink from the nearest ink-printing drop ejector array 272 hitting the same location. When the carriage is moving drop ejector arrays 271 and 272 from right to left at 1 meter per second, if s=20 mm, then the time delay between drops of anti-curl solution hitting the recording medium and the first ink drops hitting the same location is 20 milliseconds. The allowed direction of carriage motion for printing to reduce curl in the example of 7A is right to left for the anti-curl solution from drop ejector array 271 (as indicated by white block arrow 281 showing the carriage direction for printing anti-curl) and is also right to left for ink printing from drop ejector arrays 272 (as indicated by shaded block arrow 282 showing the carriage direction for printing ink). Printing ink and ejecting anti-curl solution while the carriage moves from left to right is generally not allowed in this example, because anti-curl solution would be deposited on top of printed regions and would locally wash out the image. In summary, in this example, the width of the printhead 250 in the region of the printhead die 251 (see FIG. 2) would need to increase by about 20 mm, and printing throughput would be decreased by about a factor of 2 relative to bidirectional printing. Paper advance would occur alter the right to left printing pass. An alternative print mode using the drop ejector configuration of FIG. 7A is a 2-pass print mode where anti-curl solution and a portion of the image swath is printed right to left, and then without advancing the paper, the remainder of the image is printed left to right.

The example of FIG. 7B is similar to that of FIG. 7A, but an additional drop ejector array 274 for ejecting anti-curl solution is added on the opposite side of ink-printing drop ejector arrays 272, and only new features relative to FIG. 7A will be described for FIG. 7B. The spacing s from drop ejector array 274 to its nearest ink-printing drop ejector array 272 is similarly s=20 mm as in the example of FIG. 7A. Thus the width of the printhead 250 in the region of the printhead die 251 would increase by an additional 20 mm (i.e. 40 mm wider than without drop ejector arrays 271 and 274). However, the ink-printing drop ejector arrays are now allowed to print bidirectionally for full-speed printing throughput, as indicated by the double-headed shaded block arrow 283 showing bidirectional carriage motion for printing ink. Drop ejector array 271 ejects anti-curl solution before printing with drop ejector arrays 272 as the carriage moves from right to left (as indicated by white block arrow 281), and drop ejector array 274 ejects anti-curl solution before printing with drop ejector arrays 272 as the carriage moves from left to right (as indicated by white block arrow 284 showing carriage motion for ejecting anti-curl solution in an opposite direction to 281). Drop ejector array 274 can be fluidically connected to the same supply of anti-curl solution that drop ejector array 271 is fluidically connected to, or drop ejector array 274 can be fluidically connected to a different supply of anti-curl solution. Paper advance would be done after each right to left printing puss and after each left to right printing pass.

Figure 7D:
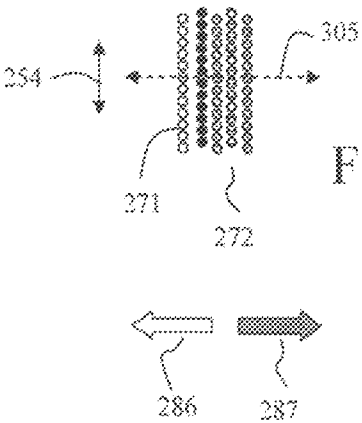
Figure 7C:
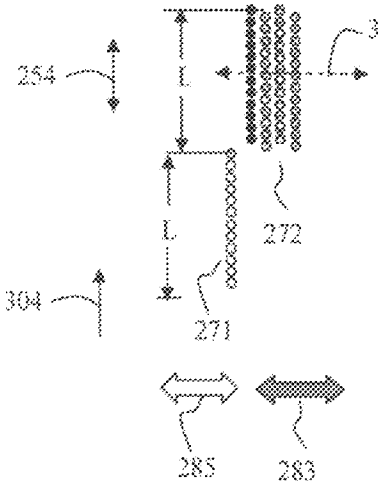

In the example of FIG. 7C, drop ejector array 271 is offset along the nozzle array direction 254 from the ink-printing drop ejector arrays 272. In particular in FIG. 7C, the ink-printing drop ejector arrays 272 and the anti-curl ejecting drop ejector array 271 have a length L, and a first nozzle of the anti-curl ejecting drop ejector array 271 is offset from a first nozzle of the ink printing drop ejector arrays 272 by a distance that is substantially equal to L. As paper is advanced into the printing, region along media advance direction 304, the paper is positioned below anti-curl ejecting drop ejector array 271 before it is positioned below ink-printing drop ejector arrays 272. In this example, the anti-curl solution can be ejected as the carriage moves bidirectionally (as indicated by white double headed block arrow 285), and the ink can be printed as the carriage moves bidirectionally (as indicated by the shaded double headed block arrow 283). In this example, the smallest amount of delay time between the ejection of anti-curl solution onto a portion of the recording medium and the printing of ink onto the same portion oldie recording medium is equal to the turnaround time of the carriage, i.e. the amount of time to decelerate the carriage from its present direction of motion, stop the carriage, and accelerate the carriage in the opposite direction of motion. For a carriage velocity of half a meter per second and an acceleration and deceleration of 20 meters per second per second (about 2 g), the acceleration and deceleration times are each approximately 25 milliseconds. Including a stop time of about 10 milliseconds, the total delay time between ejecting anti-curl solution near a side edge of the recording medium and ejecting ink onto the side edge in a next pass of the carriage in the opposite direction after advancing the recording medium is at least 60 milliseconds, which is significantly larger than the preferred delay time of at least 20 milliseconds. Paper advance would be done after each right to left printing pass and alter each left to right printing pass.

Although the example of FIG. 7C has an advantage of printing throughput, due to being able to print bidirectionally, a drawback of the configuration is that the overall nozzle face of the printhead has a length that is equal to 2 L. It can be difficult tai keep the recording medium sufficiently flat in the longer printing region, so that it may become necessary to space the nozzle face at a greater distance from the recording medium than if the nozzle face had a length of L. However, this can degrade image quality because some drops tend to be misdirected at an angle from the nozzle face. In some embodiments the anti-curl ejecting drop ejector array 271 is offset by less than the length L of the ink-printing drop ejector arrays 272. Offsetting the anti-curl drop ejector array by a distance L would be appropriate in order to allow deposition of anti-curl solution ahead of printing for single-pass printing where all of the pixels of the swath of image are printed in a single pass of the carriage. However, single pass printing is typically only used for draft modes that typically have a small area coverage of ink, and are not very susceptible to curl. For printing of color graphics or photographs, it is more typical to use at least two passes of printing. Multipass printing helps to cover up image defects. After each pass in N-pass printing, the recording medium is advanced by a distance substantially equal to L/N, where N is typically less than 10. Thus in two pass printing the recording medium is advance by approximately L/2. As a result, the anti-curl ejecting drop ejector array only needs to be offset along the nozzle array direction 254 from ink-printing drop ejector arrays 272 by about L/2 (rather than L as shown in FIG. 2C) for embodiments where anti-curl solution will only be ejected in a 2 pass print mode (or other print mode with more passes). This can allow a nozzle face length of only 1.5 L, which is more compatible with a flat print zone region. Similarly, for embodiments where anti-curl solution will only be ejected in a 4 pass mode (or other print modes with more than 4 passes), the offset between drop ejector arrays 271 and 272 can be reduced to 0.25 L and still allow bidirectional printing. More generally, the offset between drop ejector arrays 271 and 272 along nozzle array direction 254 in embodiments similar to FIG. 7C will be greater than L/10 and less than or equal to L. Finally, although a drop ejector length of L is shown for drop ejector array 272 in FIG. 7C, for embodiments where anti-curl solution is only ejected in multipass modes haying a minimum number of N passes, the length of drop ejector array 272 can be reduced to L/N.

A more compact configuration of drop ejector arrays 271 and 272 is shown in FIG. 7D, where the nozzles of anti-curl ejecting drop ejector array 271 are neither spaced a distance s away from the ink printing drop ejector arrays 272 as in FIGS. 7A and 7B, nor offset along the nozzle array direction 254 as in FIG. 7C. For the configuration shown in FIG. 7D, anti-curl solution is ejected from drop ejector array 271 when the carriage is moving in the right to left carriage direction indicated by white block arrow 286. Printing by drop ejector arrays 272 is done in a subsequent pass (without advancing the paper) in the opposite left to right direction indicated by shaded block arrow 287 after turnaround of the carriage at the left side of the page. Paper advance would occur after the left to right printing pass. As discussed above, typical turnaround times exceed the preferred delay time between ejecting of anti-curl solution onto a given location of the recording medium and printing ink in the same location of the recording medium. Although ink printing preceded by ejection of anti-curl solution can generally only occur in one direction, for high quality printing unidirectional printing can be desirable anyway, because it preserves the order of laydown of ink. For example, yellow ink can always be on top of cyan in unidirectional printing, rather than being on top for one direction of priming and on the bottom for the opposite direction of printing. Although other methods of reducing color banding have been provided for bidirectional printing, unidirectional printing can be most highly capable of reducing color banding.

For print modes such as the one illustrated in FIG. 7D, the anti-curl solution can be ejected in a fast-moving carriage pass in one direction at a carriage speed of 40 inches per second or greater, for example. Then printing can occur during a carriage pass in the opposite direction. The printing pass can be done at lower carriage velocity than the anti-curl ejection pass (e.g. less than 40 inches per second), in order to provide good print quality with improved printing throughput. In an example discussed below, an anti-curl solution coverage 50% on the recording medium is indicated. Such a coverage can be provided by printing 6 pl drops at 1200 per inch along the nozzle array direction and at 300 per inch along the carriage scan direction. If the maximum firing frequency of a drop ejector for ejecting 6 pl drops is 18 kHz, then the maximum carriage velocity for ejecting the anti-curl solution in 6 pl drops would be 60 inches per second. Alternatively, 50% coverage can be provided by printing 3 pl drops at 1200 per inch along the nozzle array direction and at 600 per inch along the carriage scan direction. If the maximum firing frequency of a drop ejector for ejecting 3 pl drops is 24 kHz, then the maximum carriage velocity for ejecting the anti-curl solution in 3 pl drops would be 40 inches per second. Thus for printheads having two different sized drop ejectors (as discussed above relative to FIG. 1) it can be advantageous for printing throughput if the anti-curl solution is ejected by a drop ejector array with larger nozzles for printing larger drops. This can be particularly true for high viscosity anti-curl solutions having a viscosity of greater than 3.0 centipoises.

Figure 8:
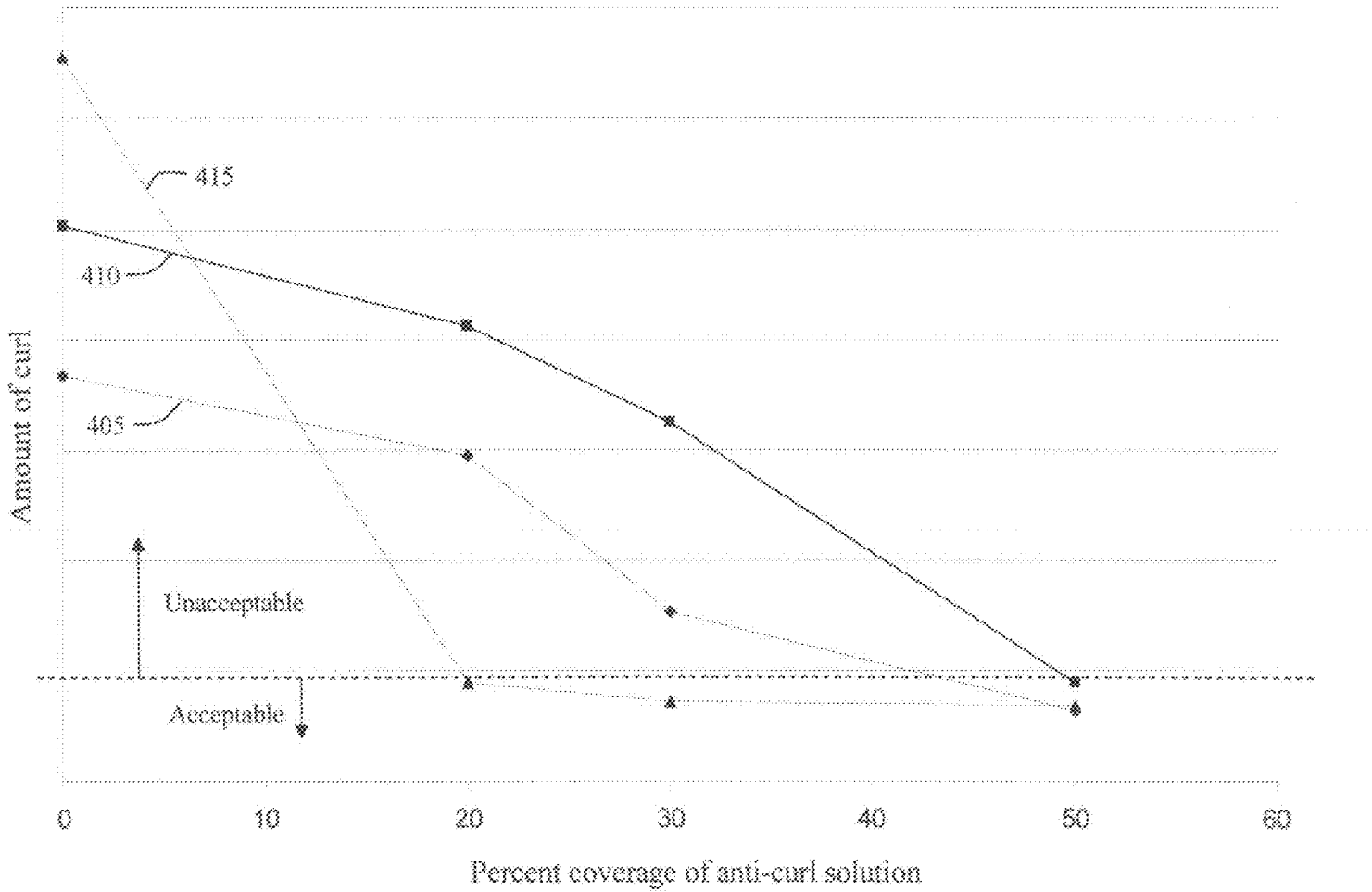
FIG. 8 shows a graph of experimental data showing the amount of curl versus the percentage of coverage of anti-curl solution for three different amounts of ink coverage.

FIG. 8 shows a graph of representative experimental data of the amount of curl as a function of percent coverage of anti-curl solution for three different amounts of coverage of ink. A delay time of 22 milliseconds between ejecting anti-curl solution and printing ink drops in the same region was used and the paper was a plain paper. Curve 405 represents the amount of curl for 50% ink coverage (i.e. an average acme 3 pl drop of ink at 1200 per inch along the nozzle array direction and 600 per inch along the carriage scan direction). Curve 410 represents the amount of curl for 100% ink coverage (i.e. an average of two 3 pl drops of ink at 1200 per inch along the nozzle array direction and 600 per inch along the carriage scan direction). Curve 415 represents the amount of curl for 150% ink coverage (i.e. an average of three 3 pl drops of ink at 1200 per inch along the nozzle array direction and 600 per inch along the carriage scan direction). An acceptable amount of curl is shown below the clashed line in the graph, and an unacceptable amount of curl is shown above the dashed line. As can be seen in the graph, if no anti-curl solution is applied, the amount of curl far exceeds the acceptable level. With no anti-curl solution, the amount of curl is worst for 150% ink coverage (curve 415), and next worst for 100% ink coverage (curve 410), but all three cases are unacceptable. With 150% ink coverage (curve 415) the amount of curt drops sharply with the amount or anti-curl solution. For 20% to 50% coverage of anti-curl solution and 150% ink coverage (curve 415) the amount of curl becomes acceptable. With 100% ink coverage (curve 410) the amount of curl becomes acceptable only when the coverage of anti-curl solution reaches about 50%. With 50% ink coverage (curve 405) the amount of curl becomes acceptable when the coverage of anti-curl solution is about 40% to 50%. Although not shown in FIG. 8, the amount of curl decreases as the delay time increases about 20 milliseconds. Also, although not shown in FIG. 8, it is found that no anti-curl solution is required to provide acceptable levels of curl if the ink coverage is less than ten percent.

In summary, if the anti-curl solution is ejected onto a given location of the recording medium, and then ink is printed onto the same location of recording medium after a delay time of at least 15 milliseconds, and preferably greater than 20 milliseconds, the amount of curl will be acceptable on a plain paper having an average ink coverage of between 50% and 100% if the average coverage of anti-curl solution is between 40% and 60%. If the amount of ink coverage is between 100% and 150%, the amount of curl will be acceptable on plain paper if the average coverage of anti-curl solution is between 15% and 40%. In practice the controller 141 (see FIG. 1) can analyze the image data to determine an amount of ink coverage for an image. The controller can then select an amount of anti-curl solution to be ejected onto the recording medium depending upon the determined total amount of ink coverage, and also depending on the type of recording medium that is about to be printed. The type of recording medium is detectable by some printers, while other printers require the user to input the type of recording medium. The controller controls the ejection of anti-curl solution from the corresponding drop ejector array onto a portion of recording medium to provide the appropriate amount of coverage of anti-curl solution. Then alter the delay time, the controller controls the ink-printing drop ejector arrays to print according to the image data on the same portion of recording medium. After printing a swath of image while the carriage moves the drop ejector arrays, the process is continued (with paper advances as needed depending on the configuration of drop ejectors as discussed relative to FIGS. 7A to 7D) and so forming the image swath by swath with acceptable levels of curl.

In ejecting, the required amount of anti-curl solution onto the recording medium, the controller can cause the corresponding drop ejector array to deposit droplets at the required coverage in substantially uniform fashion across the entire page. Optionally, the controller can cause the corresponding drop ejector array to deposit droplets at heavier than average coverage in certain regions of the page and at lighter than average coverage in other regions of the page. Such a non-uniform coverage of anti-curl solution can be image dependent or not image dependent. As an example of non-image-dependent nonuniform coverage with anti-curl solution, central portions of the swaths can have a lower coverage with anti-curl solutions than portions of the swaths near the edge of the recording medium. As an example of image-dependent nonuniform coverage, areas of the recording medium that have large regions of white space can have lower than average coverage of anti-curl solution. A particular case of this is known as white space skipping. If an entire width of a swath has no ink to be printed on it, the controller can direct a paper advance through such a swath without depositing either ink or anti-curl solution, thereby increasing printing throughput.

A further example of ejecting anti-curl solution according to the direction of the controller depending on image data to be printed can provide exceptions to the general rules discussed above relative to FIGS. 7A and 7D. Although printing in a single direction was discussed as the general rule, there can be some print modes and some images for which bidirectional printing of ink and anti-curl solution can be done. For example, in a multipass print mode in which the amount of ink coverage that is printed in the first pass is sufficiently small, the required amount or anti-curl solution can be printed (at least primarily) on the first pass alter printing ink in the first pass, as long as the anti-curl solution does not land on the printed ink. Then the remaining amount of printed ink required for the image in the region of the first pass can be deposited alter paper advance in subsequent passes after the delay time inherent in the turnaround time. Such a method can allow curl reduction for some images using a compact printhead configuration such as that shown in FIG. 7D without slowing down printing throughput relative to standard multipass printing.

The invention has been described in detail with particular reference to certain preferred embodiments thereof, but it will be understood that variations and modifications can be effected within the spirit and scope of the invention.

PARTS UST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (fir second nozzle array)
181 Droplet(s) (ejected from first nozzle array)
182 Droplet(s) (ejected from second nozzle array)
200 Carriage
240 Standpipe
241 Holder (for mounting multi-chamber ink tank)
242 Inlet poll
245 End
246 Holder (for mounting single chamber ink tank)
247 Gasket
240 Wall
250 Printhead
351 Print head die
253 Nozzle array (or drop ejector array)
254 Nozzle array direction
256 Encapsulant
257 Hex circuit
258 Connector board
262 Multi-chamber ink tank
264 Single-chamber ink tank
265 Manifold
271 Drop ejector array (for anti-curl ejecting)
272 Drop ejector array(s) (for ink printing)
274 Drop ejector array (for anti-curl printing)
281 Carriage direction for ejecting anti-curl
282 Carriage direction for printing ink (same as 281)
283 Bidirectional carriage direction for printing ink

284 Carriage direction for ejecting anti-curl (opposite 281)
285 Bidirectional carriage direction for ejecting anti-curl
286 Carriage direction for ejecting anti-curl
287 Carriage direction for printing ink (opposite 286)
300 Printer chassis
302 Paper load entry direction
303 Printing region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide rail
383 Encoder fence
384 Belt
390 Printer electronics hoard
392 Cable connectors
405 Amount of curl for 50% ink coverage.
410 Amount of curl for 100% ink coverage
415 Amount of curl for 150% ink coverage

The invention claimed is:

1. A method of printing with an inkjet printer, the method comprising:

a) providing a printhead including at least a first drop ejector array and a second drop ejector array;

b) providing a carriage for moving the printhead along a printing region of the inkjet printer;

c) providing an ink supply that is fluidically connected to the first drop ejector array;

d) providing an anti-curl solution supply that is fluidically connected to the second drop ejector array;

e) providing a controller for controlling the printing operations of the printer;

f) advancing a portion of recording medium into the printing region;

g) determining a total amount of ink to be printed to create the image;

h) identifying a type of the recording medium;

i) selecting an amount of anti-curl solution to be ejected onto the recording medium, wherein the selected amount is between forty percent coverage and sixty percent coverage of the area of the recording medium if the identified type of recording medium is plain paper, and if the total amount of ink ejected by the at least first drop ejector array corresponds to an average ink coverage of between 50 percent and 100 percent of the area of the recording medium;

j) moving the carriage along a first carriage scan direction while the second drop ejector array ejects drops of anti-curl solution onto the portion of recording medium that is in the printing region according to the direction of the controller;

k) providing a delay time that is greater than 15 milliseconds after the second drop ejector ejects drops of anti-curl solution at a given location on the portion of recording medium before printing with the at least first drop ejector array;

l) moving the carriage along a second carriage scan direction while the at least first drop ejector array ejects drops of ink in an image-wise fashion onto the given location of the portion of recording medium according to control by the controller to form a swath of image; wherein the ejection of drops of ink from the at least first drop ejector array is after the 15 millisecond delay; and m) repeating steps f) through i) to form an image swath by swath on the recording medium.

2. The method according to claim 1, wherein the step of providing a delay time comprises:

decelerating the carriage as it moves in the first carriage scan direction;

stopping the carriage; and accelerating the carriage as it moves along the second carriage direction.

3. The method according to claim 2, the step of moving the carriage along the first carriage scan direction further comprises moving the carriage at a first carriage speed, and the step of moving the carriage along the second carriage scan direction further comprises moving the carriage at a second carriage speed, wherein the first carriage speed is greater than the second carriage speed.

4. The method according to claim 1, wherein the step of selecting an amount of anti-curl solution to be ejected further comprises selecting zero anti-curl solution if the total amount of ink ejected by the at least first drop ejector array is equal to an average ink coverage on the recording medium of less than ten percent of the area of the recording medium.

5. The method according to claim 1, wherein a first drop ejector of the second drop ejector array is offset from a first drop ejector of the first drop ejector array by a distance that is less than or equal to the length of the first drop ejector array, such that a leading edge of the recording medium is positioned below at least a portion of the second drop ejector array before the leading edge is positioned below a portion the first drop ejector array as the recording medium is advanced.

6. The method according to claim 5, wherein the second carriage scan direction is the same as the first carriage scan direction, such that drops of anti-curl solution are ejected onto a leading portion of the recording medium during a same time interval that drops of ink are ejected onto a trailing portion of the recording medium.

7. The method according to claim 1, wherein steps f) through j) further comprise providing a substantially uniform coverage of anti-curl solution across the recording medium.

8. The method according to claim 1, wherein steps f) through j) further comprise providing a nonuniform coverage of anti-curl solution across the recording medium.

9. The method according to claim 8, step g) further comprising using the controller to direct the ejection of drops of anti-curl solution according to image date for the image being printed.

10. The method according to claim 1, step i) further comprising ejecting drops of ink in an image-wise fashion in a multipass print mode.

11. The method according to claim 10, step g) further comprising ejecting drops of anti-curl solution primarily on a first pass of the multipass print mode.

12. A method of printing with an inkjet printer, the method comprising:

a) providing a printhead including at least a first drop ejector array and a second drop ejector array;

b) providing a carriage for moving the printhead along a printing region of the inkjet printer;

c) providing an ink supply that is fluidically connected to the first drop ejector array;

d) providing an anti-curl solution supply that is fluidically connected to the second drop ejector array;

e) providing a controller for controlling the printing operations of the printer;

f) advancing a portion of recording medium into the printing region;

g) determining a total amount of ink to be printed to create the image;

h) identifying a type of the recording medium;

i) selecting an amount of anti-curl solution to be ejected onto the recording medium, wherein the selected amount is between fifteen percent coverage and fifty percent coverage of the area of the recording medium if the identified type of recording medium is plain paper, and if the total amount of ink ejected by the at least first drop ejector array corresponds to an average ink coverage of between 100 percent and 150 percent of the area of the recording medium;

j) moving the carriage along a first carriage scan direction while the second drop ejector array ejects drops of anti-curl solution onto the portion of recording medium that is in the printing region according to the direction of the controller;

k) providing a delay time that is greater than 15 milliseconds after the second drop ejector ejects drops of anti-curl solution at a given location on the portion of recording medium before printing with the at least first drop ejector array;

l) moving the carriage along a second carriage scan direction while the at least first drop ejector array ejects drops of ink in an image-wise fashion onto the given location of the portion of recording medium according to control by the controller to form a swath of image; wherein the ejection of drops of ink from the at least first drop ejector array is after the 15 millisecond delay; and m) repeating steps f) through i) to form an image swath by swath on the recording medium.

13. The method according to claim 12, wherein the step of providing a delay time comprises:

decelerating the carriage as it moves in the first carriage scan direction;

stopping the carriage; and accelerating the carriage as it moves along the second carriage direction.

14. The method according to claim 13, the step of moving the carriage along the first carriage scan direction further comprises moving the carriage at a first carriage speed, and the step of moving the carriage along the second carriage scan direction further comprises moving the carriage at a second carriage speed, wherein the first carriage speed is greater than the second carriage speed.

15. The method according to claim 12, wherein a first drop ejector of the second drop ejector array is offset from a first drop ejector of the first drop ejector array by a distance that is less than or equal to the length of the first drop ejector array, such that a leading edge of the recording medium is positioned below at least a portion of the second drop ejector array before the leading edge is positioned below a portion the first drop ejector array as the recording medium is advanced.

16. The method according to claim 15, wherein the second carriage scan direction is the same as the first carriage scan direction, such that drops of anti-curl solution are ejected onto a leading portion of the recording medium during a same time interval that drops of ink are ejected onto a trailing portion of the recording medium.

17. The method according to claim 12, wherein steps f) through j) further comprise providing a substantially uniform coverage of anti-curl solution across the recording medium.

18. The method according to claim 12, wherein steps f) through j) further comprise providing a nonuniform coverage of anti-curl solution across the recording medium.

19. The method according to claim 18, step g) further comprising using the controller to direct the ejection of drops of anti-curl solution according to image date for the image being printed.

20. The method according to claim 12, step i) further comprising ejecting drops of ink in an image-wise fashion in a multipass print mode.

* * * * *